United States Patent [19]

Adams

[11] 3,972,444

[45] Aug. 3, 1976

[54] FLOATING ROOF HAVING UNIFORMLY DISTRIBUTED BUOYANCY MEANS

[75] Inventor: John H. Adams, Pittsburgh, Pa.

[73] Assignee: Pittsburgh des Moines Steel Company, Pittsburgh, Pa.

[22] Filed: Apr. 10, 1975

[21] Appl. No.: 566,988

[52] U.S. Cl. ..... 220/222

[51] Int. Cl.[2] ..... B65D 87/20

[58] Field of Search ..... 220/216–227; 9/11 R, 11 F; 114/.5 BD, .5 F, 43.5 R, 43.5 AC, 123; 4/172.12, 172.13, 172.14

[56] References Cited

UNITED STATES PATENTS

| | | | |
|---|---|---|---|
| 1,753,399 | 4/1930 | Blair | 114/43.5 AC X |
| 1,879,572 | 9/1932 | Speegle | 220/221 |
| 1,893,162 | 1/1933 | Cranz | 220/222 |
| 3,104,775 | 9/1963 | Champagnat | 220/220 |
| 3,166,315 | 1/1965 | Jewett | 114/.5 F X |
| 3,587,911 | 6/1971 | Creith | 220/220 |
| 3,673,973 | 7/1972 | Glosten | 114/43.5 R X |
| 3,724,704 | 4/1973 | Edwards et al. | 220/226 |

*Primary Examiner*—William Price
*Assistant Examiner*—Stephen Marcus
*Attorney, Agent, or Firm*—Shoemaker and Mattare, Ltd.

[57] ABSTRACT

A floating roof for floating on and covering a liquid product stored in a tank, comprises a substantially flat, planar deck having a seal fixed to the periphery thereof and engaged with an inner wall surface of the tank, and a plurality of separate and independent buoy units secured on the deck to provide uniform buoyant support for the roof in the event of leakage of stored product onto the upper surface of the deck, said buoy units arranged such that lines drawn between the centers of any three adjacent units form a substantially equilateral triangle, and all of the buoy units together having a buoyancy at least as great as the total weight of the roof.

17 Claims, 7 Drawing Figures

FIG. 3.
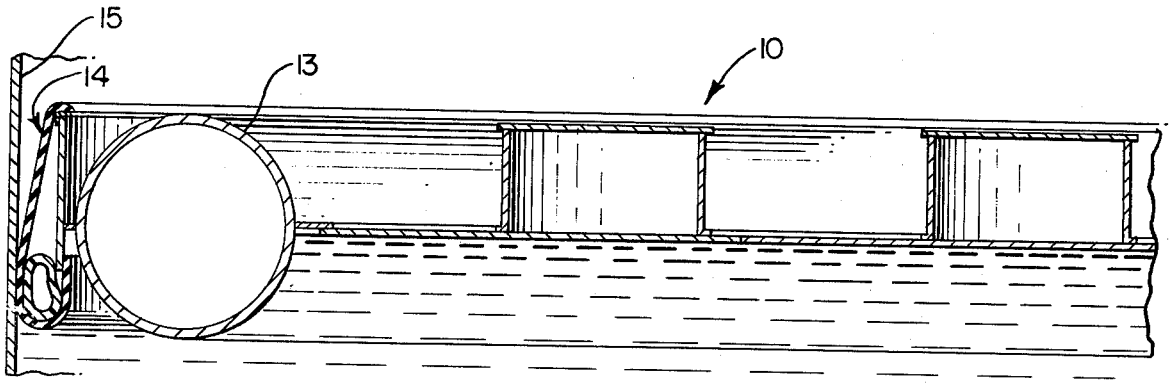
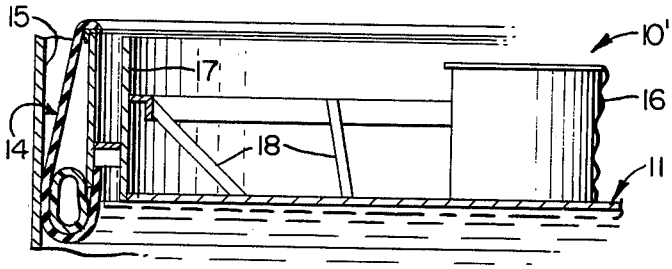
FIG. 4.
FIG. 5.
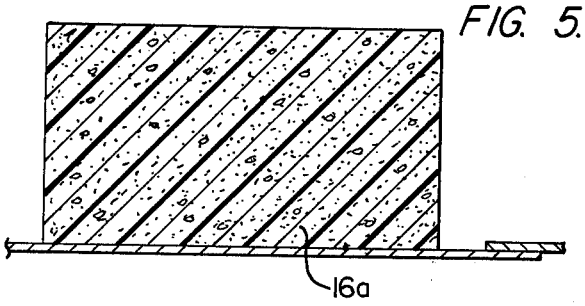
FIG. 6.
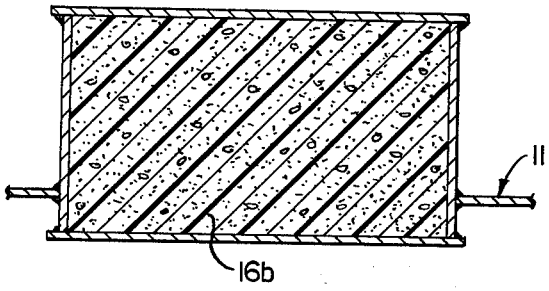
FIG. 7.
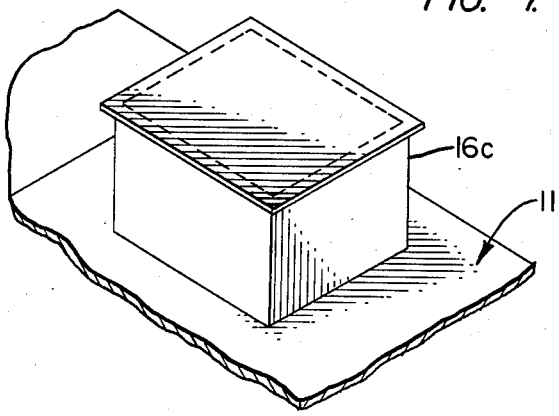

FLOATING ROOF HAVING UNIFORMLY DISTRIBUTED BUOYANCY MEANS

BACKGROUND OF THE INVENTION

This invention relates to floating roofs for covering liquid products, such as petroleum products and the like, in large storage tanks, and wherein the roof floats on the stored liquid product. Such roofs typically comprise a substantially flat, planar deck and an annular pontoon secured to a peripheral portion of the deck and seal means engaged between the roof and an inner side wall surface of the tank. Another typical construction comprises a substantially flat, planar deck having an upstanding peripheral rim thereon and seal means engaged between the rim and an inner side wall surface of the tank, said roof floating as a shallow pan on the liquid stored in the tank. It is desirable, regardless of the structure of the roof, that the deck be in substantially complete contact with the stored liquid product to prevent accumulation of vapors and also to prevent contamination of the stored liquid. Also, it is desirable to provide some means operatively connected with the deck, such that in the event of leakage of stored liquid onto the upper surface of the deck, sinking of the roof is eliminated and uneven settling of the deck is minimized. For example, some tanks may approach or exceed 300 feet in diameter, and if liquid product leaks onto the upper surface of the deck in these tanks, the deck may sag at the center up to 40 inches, and this may result in permanent deformation or damage to the floating roof structure. Also, floating roofs of the pan type could sink into the stored liquid and settle to the bottom of the tank if the stored liquid leaks onto the upper surface thereof.

Various attempts have been made in the prior art to solve the above problems, and several such approaches have utilized the attachment of a plurality of separate buoys or buoy units to the deck, such that if stored liquid leaks onto the upper surface of the deck, the buoys displace the leaked liquid and impart buoyancy to the roof to float the roof and prevent sinking or uneven settling thereof into the stored product. However, in all such prior art constructions the buoy units are not completely uniformly and even spaced apart on the surface of the deck, and in fact, in some prior art arrangements the buoys radiate much like spokes of a wheel, thus defining large pockets in which leaked product could accummulate, and also leaving relatively large expanses of the deck unsupported. Other such arrangements utilize a plurality of separate and independent buoy units secured to the deck, wherein if lines were drawn between the centers of adjacent buoys, rectangular configurations would be formed, or in other words, the buoy units are arranged in repeating rectangular grid arrangements on the deck. However, this type construction requires the use of a large number of buoy units and there is relatively uneven support for some portions of the deck. For example, in one such typical construction the distance between adjacent buoys in one direction may be between 18 and 19 feet, and the distance between adjacent buoys in a direction perpendicular to the first direction may be on the order of 22 or 23 feet.

In accordance with the present invention, a plurality of spaced apart, separate and independent buoy units are secured to the deck of a floating roof and extend upwardly therefrom, and the buoy units are arranged such that lines drawn between the centers of any three mutually adjacent buoys form a substantially equilateral triangle. Thus, with the present invention any given buoy is permitted to support more deck area than prior art devices, meaning that a fewer number of buoys can be employed to support a given roof. Also, the substantially equilateral triangular spacing between adjacent buoys results in a more even distribution of the load on the deck, and a resultant generally lower state of stress in the deck. Further, the deflection of the deck between adjacent buoys is lower in magnitude than prior art structures, with the result that a given load is supported in a more uniform manner. Also, the buoys or buoy units located adjacent the periphery of the deck are more evenly distributed when compared with prior art structures.

OBJECTS OF THE INVENTION

Accordingly, it is an object of this invention to provide a floating roof for floating on and covering a liquid product stored in a tank, wherein the roof comprises a substantially flat deck, having a plurality of separate and independent uniformly spaced apart buoy units secured thereto and extending upwardly therefrom to impart substantially uniform buoyant support to the roof in the event of leakage of stored liquid onto the upper surface thereof, and wherein the buoy units are arranged such that lines drawn between the centers of adjacent buoy units form a substantially equilateral triangle, with the result that fewer buoy units are required to support a given roof than are required in accordance with prior art structures, and also, the arrangement of buoy units provides more uniform support to the deck in the event of leakage of liquid thereonto and deflection and stresses of the deck between adjacent buoys is lower in magnitude than with prior art structures.

BRIEF DESCRIPTION OF THE DRAWINGS

FIG. 3 is an enlarged, fragmentary, sectional view taken along line 3—3 in FIG. 1.

FIG. 4 is a view similar to FIG. 3 of a modified roof structure.

FIG. 5 is a greatly enlarged, vertical sectional view of a first form of buoy unit for use in the invention.

FIG. 6 is a view similar to FIG. 5 of a further form of buoy unit suitable for use in the invention.

FIG. 7 is a perspective, fragmentary view showing a further form of buoy unit suitable for use in the invention.

DETAILED DESCRIPTION OF THE INVENTION

Figure 1:
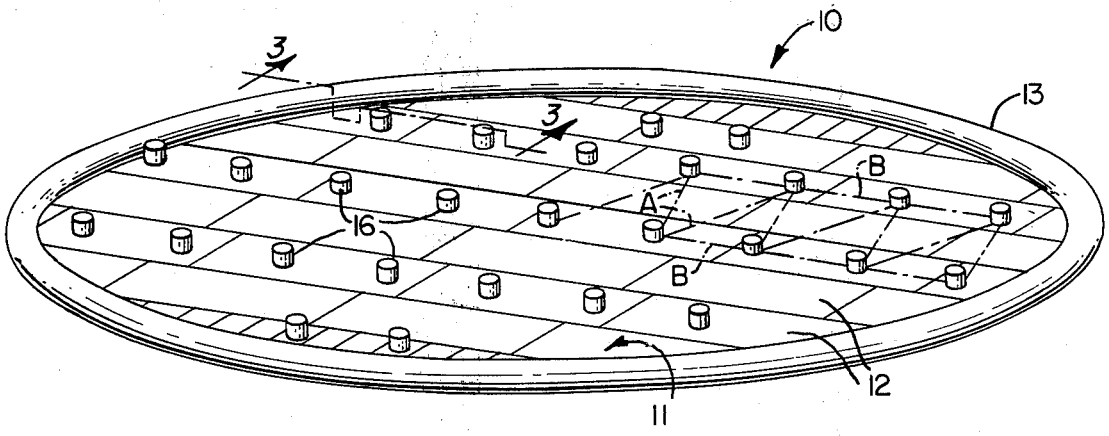
FIG. 1 is a top perspective view of a roof in accordance with the invention, showing the deck and an annular pontoon secured thereto, and a plurality of separate and spaced apart buoy units secured thereto and arranged such that lines drawn between the centers of any three adjacent buoys form a substantially equilateral triangle.

In the drawings, wherein like reference numerals indicate like parts throughout the several views, a floating roof in accordance with the invention is indicated generally at 10 and comprises a deck 11 made up of a plurality of plates 12 secured together in edge-to-edge relationship, and an annular pontoon 13 of suitable conventional construction secured to the periphery of the deck 11. Suitable seal means 14 is secured to the pontoon 13 for cooperation with an inner surface of a side wall 15 of the tank, in a manner as more fully described in Edwards et al. U.S. Pat. No. 3,724,704.

A plurality of separate and independent, substantially uniformly spaced apart buoys or buoy units 16 are secured to the deck 11 and extend upwardly from the upper surface thereof to provide substantially uniform buoyant support for the roof in the event of leakage of stored liquid onto the upper surface thereof, and thus to prevent sinking or uneven settling of the deck into the stored liquid.

Figure 2:
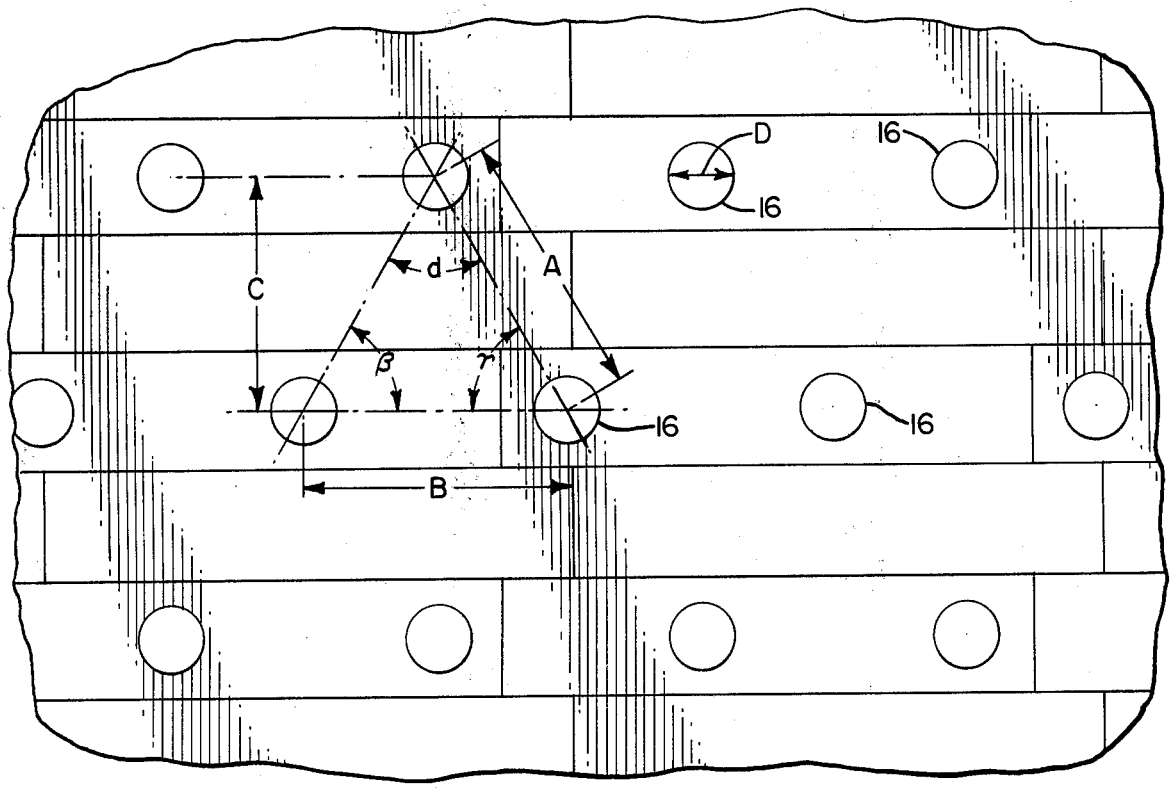
FIG. 2 is an enlarged top plan view of a portion of the roof of FIG. 1, showing the arrangement of buoy units thereon.

As seen best in FIG. 2, the buoy units 16 are arranged such that lines drawn between the centers of any three adjacent buoy units form an equilateral triangle, wherein the angles $\alpha$, $\beta$ and $\gamma$ are all equal to 60° and the distances A and B between adjacent buoys are equal to one another. In fact, the distance B between adjacent buoy units when the buoy units are arranged as shown in FIG. 2 may be substantially greater than the corresponding distance between adjacent buoys when the buoys are arranged in a rectangular pattern, as is done in some prior art devices, and the buoy units will still provide the same amount of buoyant lifting force for the deck in the event of leakage of stored liquid thereonto.

In one specific construction of roof in accordance with the present invention, the distances A and B are each equal to 25.693 feet and the distance C is equal to 22 feet, 3 inches, and the buoy units 16 each have a diameter of about 8 feet.

A modified floating roof 10' is illustrated in FIG. 4, and in this form of the invention, rather than an annular pontoon 13 secured to the periphery of the deck 11, an annular, upstanding rim 17 is fixed to the outer peripheral edge of the deck 11 and suitable brace means, such as diagonally extending braces 18 are connected therewith to rigidify and reinforce the upstanding rim 17. A seal 14 is then operatively connected between the upstanding rim 17 and the inner surface 15 of the side wall of the tank, as previously described. In this form of the invention, the roof 10' floats as a shallow pan on the stored liquid product, and the buoy units 16 are arranged as described previously to impart buoyant support to the roof in the event of leakage of stored liquid onto the upper surface thereof.

The deck 11 may comprise any suitable material, such as steel, aluminum or glass fiber reinforced plastic and the like, and the buoy units 16 may have any suitable size and shape, depending upon the requirements of the particular installation, and may be either hollow, as seen in FIGS. 3 and 4, or solid blocks of foam material or the like, as indicated at **16*a* and 16*b* in FIGS. 5 and 6, respectively. Further, the buoy units may extend below the surface of the deck 11, as indicated in FIG. 6**.

In FIG. 7 a rectangularly shaped buoy unit **16*c*** is illustrated.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A floating roof for floating on and covering liquid material stored in a tank, comprising: a substantially flat, planar deck having an upper surface and a lower surface and a peripheral portion spaced from an inner wall surface of the tank; seal means secured to the peripheral portion to effect a seal between the floating roof and an inner surface of a tank wall; and a plurality of uniformly spaced apart, separate and independent buoy units secured to the deck and extending upwardly therefrom and each having a buoyancy when submerged in the stored product at least as great as the sum of its weight and the weight of a predetermined adjacent portion of the deck to provide uniform buoyant support to the deck in the event of leakage of stored liquid onto the upper surface of the deck and thus prevent sinking of the roof and minimize uneven settling of the deck in the stored liquid, said buoy units arranged such that lines drawn between the centers of any three mutually adjacent buoy units form a substantially equilateral triangle, thus minimizing stress in the deck and minimizing settling of the deck into the stored liquid in the event of leakage of the stored liquid onto the upper surface of the deck.

2. A floating roof as in claim 1, wherein the roof is a pan roof and includes a substantially flat deck having an upstanding peripheral rim thereon, whereby the roof floats as a shallow pan.

3. A floating roof as in claim 2, wherein the deck comprises a plurality of metallic plates secured together in edge-to-edge relationship, and the buoy units are secured on top of the deck and extend upwardly therefrom.

4. A floating roof as in claim 2, wherein the deck comprises a plurality of plates secured together in edge-to-edge relationship, and the buoy units are upstanding and are secured to the plates and extend at their lower ends slightly below the deck and extend at their upper ends above the deck, the major portion of the buoy units extending above the deck.

5. A floating roof as in claim 2, wherein the lines drawn between the centers of said three adjacent buoy units are all of equal length, said deck comprises a plurality of rectangularly shaped steel plates welded together at adjacent edges, and said buoy units are upstanding and are secured to and extend upwardly from the upper surface of the deck, said buoy units arranged evenly over substantially the entire upper area of the deck.

6. A floating roof as in claim 1, wherein the lines drawn between the centers of said three adjacent buoys are all of equal length.

7. A floating roof as in claim 6, wherein the buoy units are all substantially identical and each provides substantially the same buoyant force to the roof as the other when liquid leaks onto the upper surface of the deck.

8. A floating roof as in claim 7, wherein the buoy units are tubular.

9. A floating roof as in claim 7, wherein the buoy units comprise a substantially solid block of buoyant material.

10. A floating roof as in claim 1, wherein the roof is a pontoon roof and includes a substantially flat deck having an annular pontoon secured to the periphery thereof, whereby the pontoon provides buoyancy to float the peripheral portion of the deck.

11. A roof floating on a liquid product stored in a tank, comprising:

a membrane type deck having an upper surface and a lower surface and having a peripheral portion, the lower surface of the deck being generally in contact with the stored liquid;

said peripheral portion including a stiffening member connected to a peripheral edge of the deck and spaced radially inwardly from an inner side wall of the tank;

a sealing member attached to the stiffening member and disposed in sealing relationship with the side wall of the tank; and a plurality of buoyancy members each secured only to the deck and arranged such that lines connecting centers of any three mutually adjacent buoyancy members forms a substantially equilateral triangle, and each buoyancy member having a buoyancy when submerged in the stored liquid at least greater than the sum of its weight and a predetermined portion of the deck, said triangular arrangement of buoyancy members minimizing stress in the deck and minimizing settling of the deck into the stored liquid in the event of leakage of the stored liquid onto the upper surface of the deck.

12. A roof as in claim 11, wherein the stiffening member comprises an annular pontoon.

13. A roof as in claim 12, wherein the buoyancy members together have a buoyancy such that the combined buoyancy of the buoyancy members and pontoon provide uniform buoyant support for the roof in the event of leakage of stored liquid onto the upper surface thereof and thus prevent sinking of the roof and minimize uneven settling of the deck in the stored liquid.

14. A roof as in claim 11, wherein the stiffening member comprises an upstanding peripheral rim, whereby the roof floats as a shallow pan.

15. A roof as in claim 14, wherein the buoyancy members have a combined buoyancy such as to provide uniform buoyant support for the roof in the event of leakage of stored liquid onto the upper surface thereof and thus prevent sinking of the roof and minimize uneven settling of the deck in the stored liquid.

16. A roof as in claim 11, wherein lines drawn between centers of any three mutually adjacent buoyancy members are equal in length and subtend equal angles with one another, thus defining an equilateral triangle.

17. A roof as in claim 11, wherein the deck comprises a plurality of flat plates secured together at adjacent edges.

* * * * *